US010632356B2

(12) United States Patent
Davis et al.

(10) Patent No.: US 10,632,356 B2
(45) Date of Patent: Apr. 28, 2020

(54) GOLF GRIP WITH REMINDER RIB

(71) Applicant: Eaton Corporation, Cleveland, OH (US)

(72) Inventors: Stephen James Davis, Pinehurst, NC (US); Alex Walls, Laurinburg, NC (US); Andy Arrington, Laurinburg, NC (US); Bruce Miller, Pinehurst, NC (US)

(73) Assignee: EATON INTELLIGENT POWER, LTD., Dublin (IE)

( * ) Notice: Subject to any disclaimer, the term of this patent is extended or adjusted under 35 U.S.C. 154(b) by 0 days.

(21) Appl. No.: 15/968,919

(22) Filed: May 2, 2018

(65) Prior Publication Data

US 2018/0250566 A1 Sep. 6, 2018

Related U.S. Application Data

(62) Division of application No. 15/270,058, filed on Sep. 20, 2016, now Pat. No. 10,052,538.

(51) Int. Cl.
*A63B 60/14* (2015.01)
*A63B 60/10* (2015.01)
(Continued)

(52) U.S. Cl.
CPC ..... *A63B 60/14* (2015.10); *A63B 53/14* (2013.01); *A63B 60/10* (2015.10); *A63B 60/54* (2015.10);
(Continued)

(58) Field of Classification Search
CPC ..... A63B 60/14; A63B 60/10; A63B 60/54; A63B 53/14; A63B 2071/0694; A63B 2209/00
See application file for complete search history.

(56) References Cited

U.S. PATENT DOCUMENTS 2,280,382 A * 4/1942 Davis ..... A63B 49/08 473/549
5,217,380 A 6/1993 Martinet ..... A63B 69/3632 434/252
(Continued)

FOREIGN PATENT DOCUMENTS

GB 474058 10/1937
WO WO2007141637 12/2007

OTHER PUBLICATIONS

European Search Report dated Jan. 25, 2018 for European Patent Application No. 17191492.2-1126.

*Primary Examiner* — Michael D Dennis
(74) *Attorney, Agent, or Firm* — Daniel S. Kalka

(57) ABSTRACT

An improved golf club grip 10*a*, 10*b*, 10*c* with a well-defined and pronounced reminder rib 20*a*, 20*b*, 20*c* includes in one embodiment of the present disclosure a groove 32 positioned in the exterior surface 34 on each side of or surrounding a ridge 24*a* that extends lengthwise inside the body 14*a* of the grip 10*a*. When the golf grip 10*a* is installed on a golf club shaft 12, the groove 32 facilitates the flexing of the grip material for forming the reminder rib 20*a*. In another embodiment of the present disclosure, the grip 10*b*, 10*c* is provided with a raised portion 36 of a selected material in a select region on the grip 10*b*, 10*c*. When the golf grip 10*b*, 10*c* is installed on a golf club shaft 12, the raised portion 36 becomes the reminder rib 20*b*, 20*c*.

9 Claims, 7 Drawing Sheets

(51) Int. Cl.
*A63B 60/54* (2015.01)
*A63B 53/14* (2015.01)
*A63B 71/06* (2006.01)

(52) U.S. Cl.
CPC ... *A63B 2071/0694* (2013.01); *A63B 2209/00* (2013.01)

(56) References Cited

U.S. PATENT DOCUMENTS

| | | | | |
|---|---|---|---|---|
| 6,752,730 | B1 * | 6/2004 | Brine, Jr. | A63B 60/48 473/513 |
| 6,908,400 | B2 * | 6/2005 | Chu | A63B 53/14 473/303 |
| 7,435,186 | B1 | 10/2008 | Miller | |
| 8,062,147 | B2 * | 11/2011 | Johnson | A63B 53/14 473/303 |
| 8,226,497 | B2 * | 7/2012 | Chu | A63B 53/14 473/300 |
| 10,052,538 | B2 | 8/2018 | Davis et al. | |
| 10,143,902 | B1 | 12/2018 | Cavill et al. | |
| D846,051 | S | 4/2019 | Davis et al. | |
| 10,293,230 | B1 | 5/2019 | Davis | |
| 2003/0029002 | A1 | 2/2003 | Willat | |
| 2003/0228929 | A1 | 12/2003 | Miyasu et al. | |
| 2007/0287551 | A1 * | 12/2007 | Wang | A63B 53/14 473/300 |
| 2008/0227562 | A1 | 9/2008 | Gill | A01K 87/08 473/299 |
| 2009/0321001 | A1 | 12/2009 | Ulrich | |
| 2010/0298063 | A1 | 11/2010 | Gill | A63B 53/14 473/303 |

* cited by examiner

GOLF GRIP WITH REMINDER RIB

FIELD

The present disclosure relates in general to an improved golf club grip, and more particularly to a new and improved golf club grip with an improved reminder rib.

BACKGROUND

Golf is a sport of precision and repetition. The more consistent and repetitive a golfer can positions the hands on the grip of a golf club the more consistent will be the alignment with the golf club head. As a result the more consistent the golf ball will be hit, that is, the shot. Traditional golf club grips, also referred to simply as golf grips herein, have used a variety of technologies to assist the golfer in positioning the hands. Golf grips may have lines or other markings painted on the grip surface to guide the hand placement. The Professional Golf Association (PGA) rules do allow for a raised rib, referred to as a reminder rib, to be formed in the golf grip. The reminder rib is a raised ridge designed to assist the golfer in club alignment.

There still exists a need for an improved golf club grip with an improved reminder rib that has more definition for feel, and is more visible. Such a grip allows the golfer to more easily align the golf grip for better repetition in the golf game.

BRIEF SUMMARY OF THE DISCLOSURE

The present disclosure is directed to an improved golf grip with an improved exterior rib.

The improved golf club grip according to the present disclosure comprises an elongated tubular body having an end cap at one end and a bore at an opposite end. The bore is constructed to receive a golf club shaft. The tubular body is hollow and has a ridge formed inside with the ridge extending lengthwise inside the body. At least one groove is provided on an exterior surface of the tubular body with the at least one groove being positioned on the exterior surface of the body at least on one side of where the ridge is located on the interior surface of the body.

The present disclosure is also directed to an improved golf grip with an exterior rib where at least one groove is provided adjacent the raised portion of the exterior rib.

The various features of novelty which characterize the present disclosure are pointed out with particularity in the claims annexed to and forming a part of this disclosure. For a better understanding and its operating advantages attained with its use, reference is made to the accompanying drawings, and descriptive matter.

DETAILED DESCRIPTION

Figure 1:
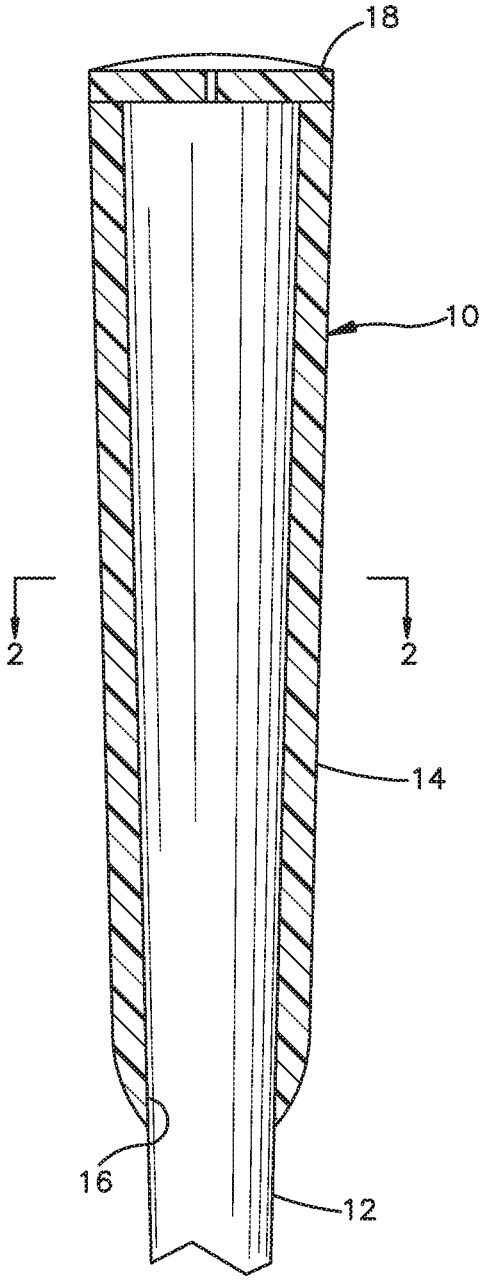
FIG. 1 is a sectional view of a golf club grip on a shaft.

Referring to the figures, which are not intended to limit the present disclosure and where like numerals designate like or similar features throughout the several views, and first in particular to FIG. 1, there is shown in sectional view a golf club grip, also referred to herein as "golf grip" or more simply "grip", generally designated 10 positioned on a golf club shaft 12. Golf grip 10 includes an elongated hollow tubular body 14 that has a slightly frustoconical shape, a bore 16 at one end, and an end cap 18 at an opposite end. Golf grip 10 is a slip-on style grip typically constructed of a rubber or other elastomeric polymer that slides on to the club shaft 12 and is secured thereon with a double sided adhesive tape or other suitable method.

Figure 2:
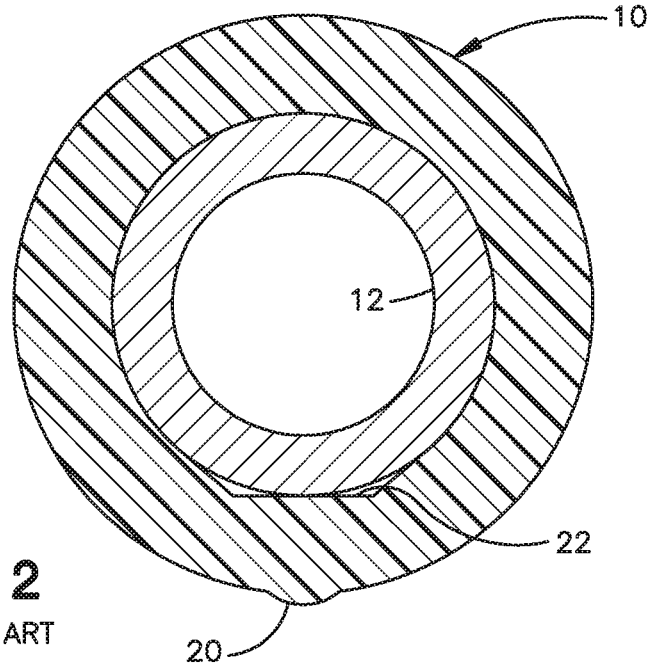
Fig. 2 PRIOR ART
FIG. 2 is a sectional view taken at lines 2-2 of FIG. 1 of a prior art golf club grip mounted on a golf club shaft with a portion of the interior surface of the golf club grip being flat for use in forming a reminder rib.
Figure 3:
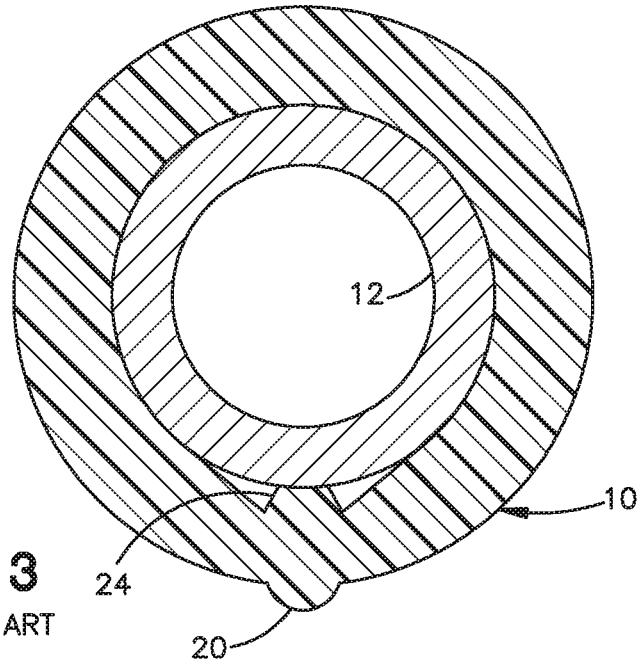
Fig. 3 PRIOR ART
FIG. 3 is a sectional view similar to FIG. 2 of another prior art golf club grip mounted on a golf club shaft with the golf club grip having a ridge on its interior surface used for forming a reminder rib.

The United States Golf Association (U.S.G.A.) and the current rules of golf require golf grips, other than putter grips, to be mostly circular in cross-section. There is an exception to this rule and that is the provision for a reminder rib. The reminder rib 20, also referred to herein as an exterior rib, may be formed by an internal geometry in the golf grip such as an internal flat 22 as seen in FIG. 2, or an internal geometrical structure appearing like a ridge or rail 24 that deforms the grip material when installed over the round club shaft 14 as seen by the sectional view in FIG. 3. The internal pressure caused by the round shaft pushing against the flat 22 or ridge 24 causes the exterior grip surface which is typically a rubber, thermoplastic material, or some other elastomeric polymer to become out-of-round forming the reminder rib 20 along the length of the grip. Because the internal ridge 24 or internal flat 22 is on the inside of the grip and hidden from the exterior of the grip 10, the installer does not see where the reminder rib 20 will be formed on the club shaft 12 when the shaft 12 is being inserted in bore 16 of grip 10 when attaching the grip 10 to the club shaft 12. This can create difficulties with proper alignment during installation of the grip 10 on shaft 12.

In a retail environment where many golf grips are sold in volume in a bin, the round regular golf grips and the golf grips formed with reminder ribs are often intermingled by mistake due to poor visibility of the reminder rib. This can cause customer confusion, disappointment, and returns.

Forming the desired size of a reminder rib 20 using an internal flat 22 or an internal ridge 24 can be difficult and sometimes unpredictable due to different types of grip material and grip sizes. Larger golf grips require more material making it more difficult to form a reminder rib that the golfer can feel. Stiffer materials used with fiber reinforced rubber are less deformable than non-reinforced rubber. Both of these conditions result in reminder ribs that are less noticeable.

Figure 4:
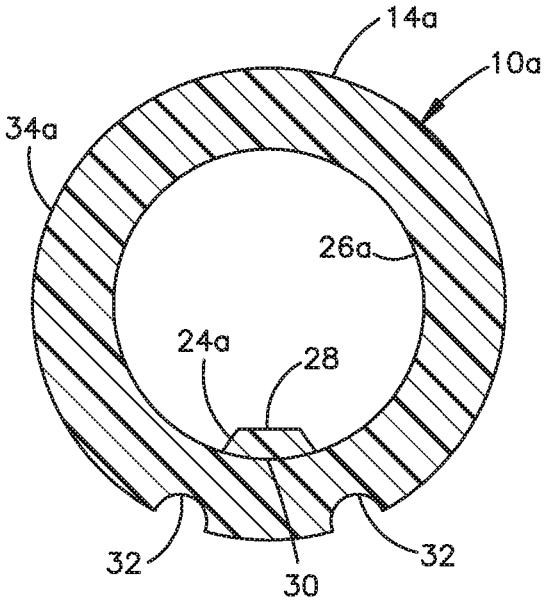
FIG. 4 is a sectional view of an improved golf club grip according to one embodiment of the present disclosure.
Figure 5:
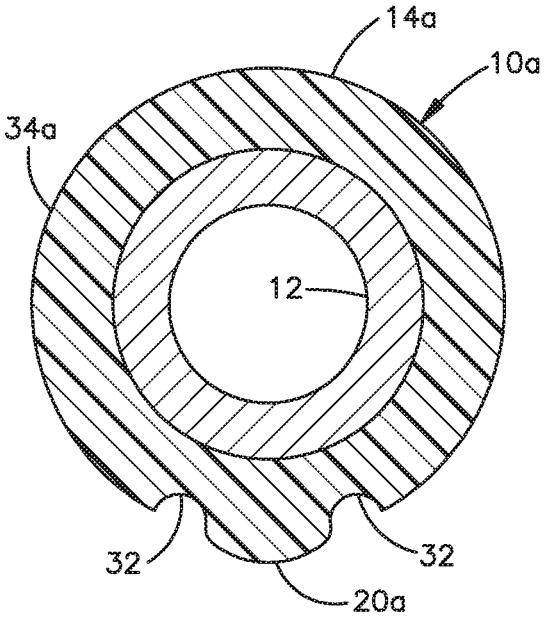
FIG. 5 is a sectional view of the golf club grip of FIG. 4 mounted on a golf club shaft with the reminder rib formed.
Figure 6:
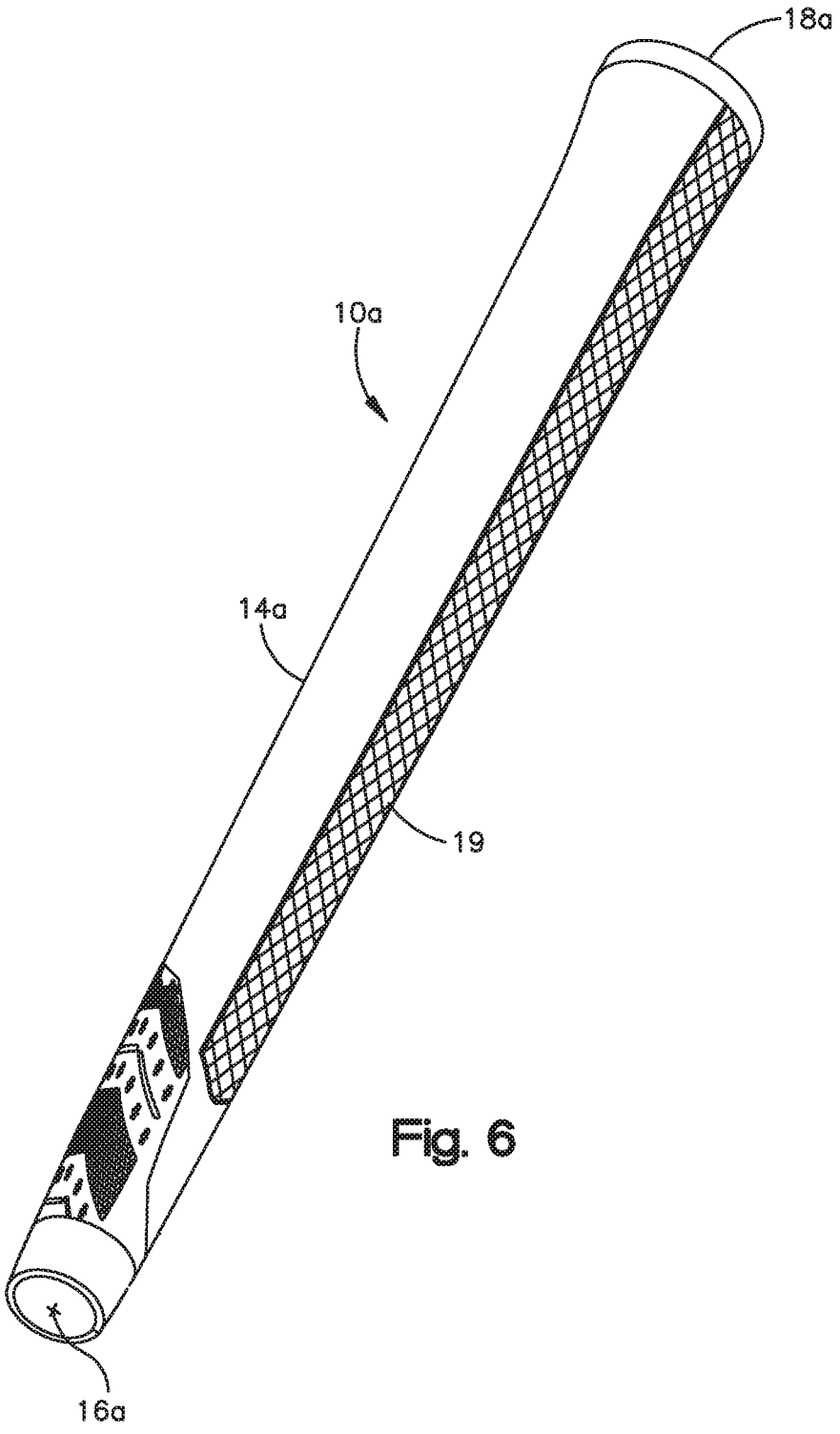
FIG. 6 is an elevated view of an improved golf club grip according to a first embodiment of the present disclosure depicting the external rib on the golf club grip.
Figure 7:
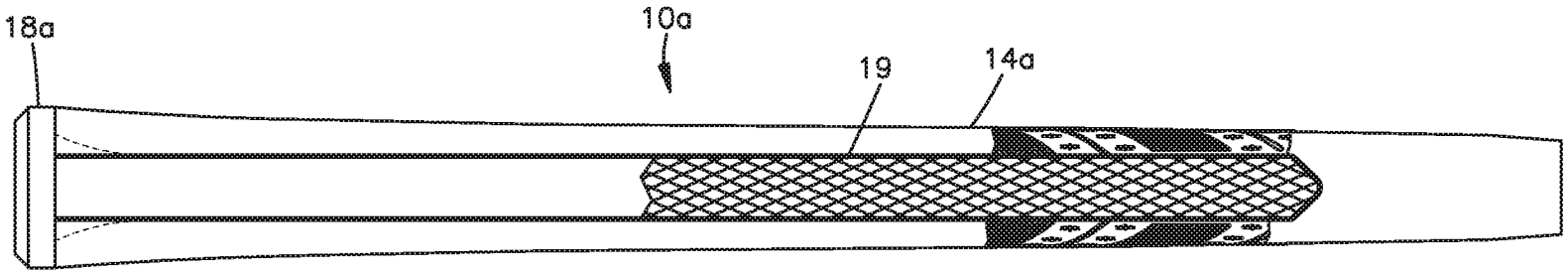
FIG. 7 is a bottom view of an improved golf club grips according to a first embodiment of the present disclosure depicting the external rib on the grip.

Referring to FIGS. 4 and 5, a first embodiment of the present disclosure provides a raised structure inside the body 14*a* of a grip 10*a* referred to as an internal ridge 24*a* positioned in the interior surface 26*a* of the golf club grip 10*a*. Ridge 24*a* may range from approximately 0.5 millimeters (mm) to approximately 3.0 mm in height, and has a width ranging from approximately 1.0 mm to approximately 6.0 mm. The height of ridge 24*a* and width of ridge 24*a* may be varied at different locations in the body 14*a* of grip 10*a* as desired to achieve a desired effect for the grip. The ridge 24*a* may have any type of geometry, structure, or shape that can vary or be consistent along its length. Ridge 24*a* extends lengthwise in a substantially straight line in the interior of the golf grip 10*a* a desired distance ranging from approximately 175 mm to approximately 250 mm which may be substantially the full length of the body 14*a* of the grip. For illustrative purposes only, the ridge 24*a* may have a trapezoidal shape where the width at the top 28 of the ridge 24*a* is less than that of its base 30. The ridge 24*a* may have a flat top or raised (crowned or rounded) top. The golf club grip 10*a* of this embodiment of the present disclosure includes at least one groove 32, and more preferably two or even more grooves 32 positioned on the exterior surface 34*a* of the golf club grip 10*a* with at least one groove 32 located on each side of the ridge 24*a*, which is on the interior of the grip 10*a*, as seen in FIG. 4. The groove 32 may extend with and even surround the ridge 24*a* on the grip at the top or butt end of the grip 10*a* near or at the end cap 18*a*, or near or at the lower end by the bore 16 of the grip 10*a* as seen in FIGS. 6 and 7 for defining a longitudinal area 19 on the exterior surface of the grip 10*a* where the reminder rib forms on the grip 10*a*. The exterior groove 32 is positioned on the exterior surface 34*a* of the grip 10*a* adjacent the corresponding edges of ridge 24*a* positioned on the interior surface 26*a*. When the groove 32 completely surrounds the location of the ridge 24*a*, this creates a contained and highly visible area 19 for the reminder rib 20*a* on the exterior surface 34*a* that is raised and visible as seen in FIGS. 5 through 7. As illustrated in FIGS. 6 and 7, the longitudinal area 19 may include a design, color, and/or texture on all or part or even none of the rib 20*a* which can be similar to or distinct from the body 14*a* of the grip 10*a*. FIGS. 6 and 7 show in partial view the longitudinal area 19 on the underside of the grip 10*a* with a partial design and texture differing from the partial design shown on the body 14*a* of the grip 10*a*. The material making up the longitudinal area 19 may have a hardness value that may be greater or softer than the body 14*a* or specific areas of the body 14*a* of grip 10*a*. While FIGS. 6 and 7 depict the longitudinal area 19 which forms the exterior rib 20*a* when installed on the golf club shaft 12 ending in a straight line formation at the end of grip 10*a*. The area 19 forming exterior rib 20*a* may have a Y-shape at any location in the grip and is depicted in dashed lines in FIG. 7. In another embodiment, the groove 32 may be utilized to form a decorative pattern on the grip and can extend up to the end cap. The groove 32 may be of any length, width, or depth desired to achieve the desired effect for forming the external rib 20*a*. At least one but more than one groove 32 may be positioned on the exterior surface 34*a* in the location on each side of internal ridge 24*a*. The groove 32 may have a depth (d) ranging from approximately 0.3 mm to approximately 2.0 mm, and run approximately the same length as the ridge 24*a* but on the exterior surface 34*a* lengthwise on the golf club grip 10*a*. The groove 32 reduces the grip wall thickness on either side of the ridge 24*a* to allow more stretch when the grip is installed to form the exterior rib 20*a* making it more pronounced on the exterior surface 34*a* of grip 10*a*. The ridge 24*a* may be formed by example as taught in U.S. Pat. No. 8,485,916 owned by the assignee of the present disclosure, and hereby incorporated by reference. The groove 32 increases the presence of exterior rib 20*a* making the reminder rib more defined and visible. The groove 32 may be decorated or painted, and can even add some form of design element, texture, and fashion to the grip design. The visible exterior rib 20*a* assists in the installation of the grip 10*a* on the shaft 12 by ensuring proper alignment on the shaft 12 which facilitates the golfer's repetition during the game.

As mentioned previously, the material making up exterior rib 20*a* may have a hardness value equal to, softer than, or harder than the remainder of grip 10*a*. Grip 10*a* may have as many as four distinct zones of hardness values measured in Shore A. For example, the lower portion of grip 10*a* has a softer durometer value than the upper portion of the grip 10*a*. The exterior rib 20*a* may have a durometer value different than those two areas or zones, and the end cap may even have its own durometer value which can be as high as approximately 70 Shore A. The durometer values for the body of the grip can range between approximately 40 to approximately 60 Shore A durometer, and can be adjusted or varied along the length of the grip according to desired feel. The exterior rib 20*a* may have a preferred hardness value of approximately Shore A 60.

Figure 8:
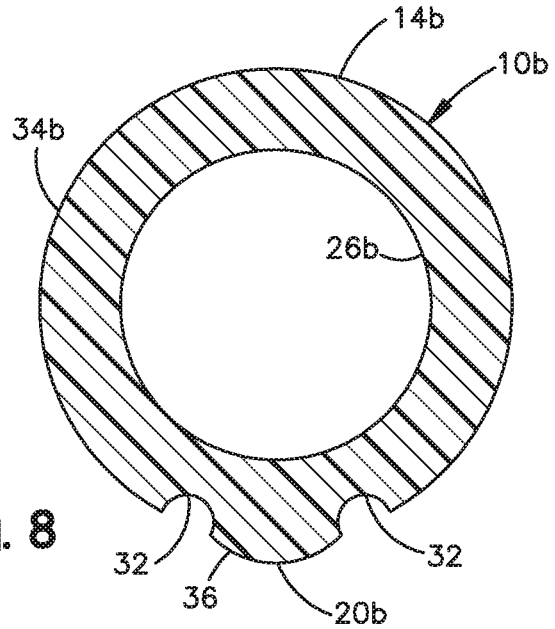
FIG. 8 is a sectional view of an improved golf club grip according to another embodiment of the present disclosure.

The present disclosure is also directed to an alternative embodiment for making the reminder rib as seen in FIG. 8. The exterior rib 20*b* in this embodiment is formed by increasing the thickness and width of the external surface to form a raised portion 36 in a desired location or region in the body 14*b* of the golf grip 10*b* along a length of the grip 10*b* in a similar manner to that of the longitudinal area 19 previously described. The raised portion 36 includes at least one groove 32 adjacent it and the raised portion 36 may have a variable geometry or shape along its length for defining the longitudinal area and shape 19 seen in FIGS. 6 and 7. At least one groove 32 adjacent the raised portion 36, as in the previous embodiment described, defines a longitudinal area 19 where the exterior rib 20*b* forms, but in this embodiment the raised portion 36 on the exterior surface of the grip 10*b* facilitates the formation upon installation of the grip 10*b* on the golf club shaft. When the grip 10*b* is mounted on the shaft 12, the thicker material of the raised portion 36 due to its increased thickness will add stiffness to the grip and forms the exterior rib 20*b* on the exterior of the grip 10*b*. The raised portion 36 may range from approximately 0.5 millimeters (mm) to approximately 2.0 mm in height, and has a width ranging from approximately 3.0 mm to approximately 10.0 mm. Raised portion 36 extends lengthwise in substantially a straight line on the exterior surface 34*b* of the golf grip 10*b* a desired distance ranging from approximately 175 mm to approximately 250 mm which may be substantially the length of the grip. The raised portion 36 in area 19 may be painted or have a design pattern or surface texture which may be the same as the rest of the grip 10*b*, or different to make the exterior rib 20*b* more visible with a distinctive feel. The exterior rib 20*b* in this embodiment may have any shape desired but should conform to the rules of golf. The exterior rib 20*b* in this embodiment as well as the others disclosed herein may form a Y-shape in at least one location on the longitudinal area of the grip, and in one embodiment forms the Y-shape near the butt end as seen in dashed lines in FIG. 7. The exterior rib 20*b* in this embodiment may be formed of the same material as the rest of the grip 10*b*, or may be made of a different material that has a harder or softer material or durometer value than the rest of grip 10*b*. The exterior rib 20*b* may be smooth or have its own color, design, or texture formed in its surface to make it a visible reminder rib. Graphics and other decorations or insignia may be included on the exterior rib 20*b* as permitted by the U.S.G.A. rules.

Grip 10*b* and exterior rib 20*b* are preferably molded of a rubber material or a fiber reinforced rubber material, but it can be made of other materials used for golf club grips, like elastomers, thermoplastics, silicone rubber, other polymers, or combinations of these materials. The grips described herein may be formed by compression molding or injection molding, or other similar manufacturing processes.

Figure 9:
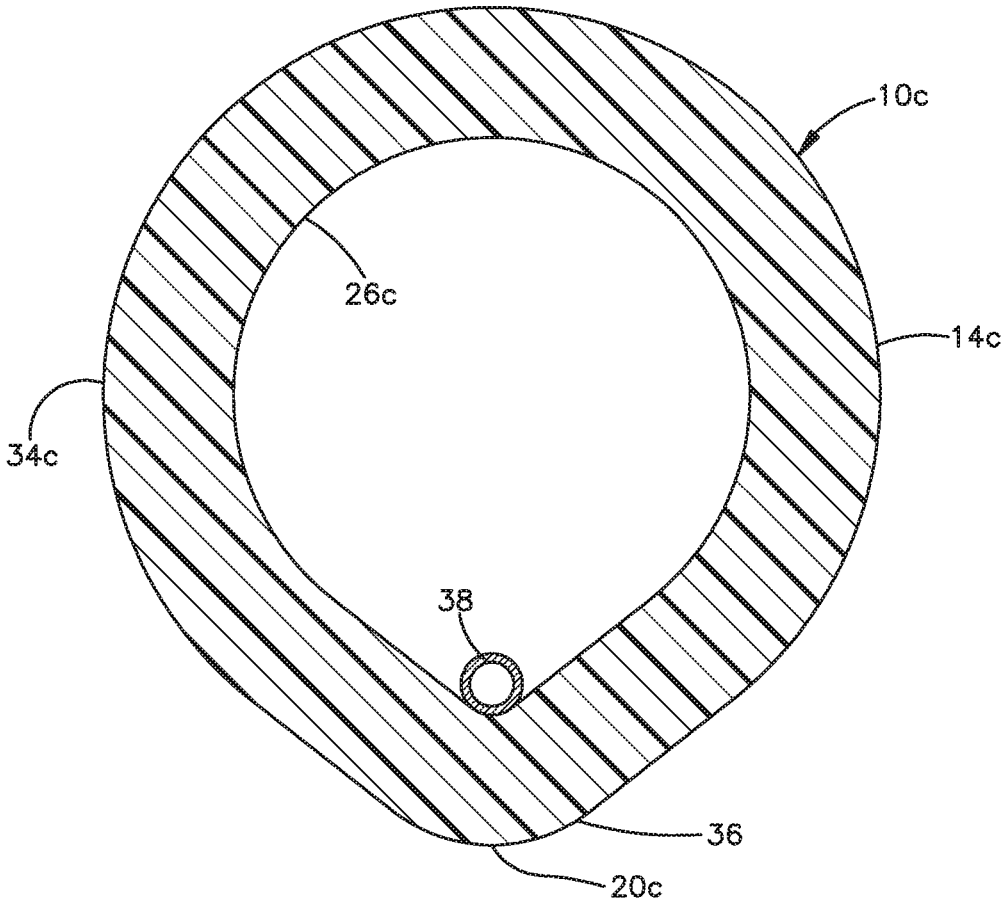
FIG. 9 is a sectional view of an improved golf club grip according to still another embodiment of the present disclosure.

The present disclosure is further directed to still yet another embodiment for an improved reminder rib 20*c* as seen in FIG. 9. Some golfers may find a reminder rib 20 too rigid or too hard, but these golfers do desire the consistent geometry provided with the reminder rib. The present disclosure found that adding an air channel 38 which is an optional ridge or tube that may be added under all or part of the raised portion 36 functions to further define the exterior rib 20*c* formed by the raised portion 36 with this embodiment. Air channel 38 allows the exterior rib 20*c* to compress during impact to provide more comfort to the golfer. This embodiment provides an exterior rib 20*c* that is noticeable and aids alignment. The air channel 38 located inside the grip 10*c* provides improved grip comfort for the exterior rib 20*c*. The air channel 38 may be of any size desired to optimize the firmness of the raised portion 36. The air channel is preferably a tube, but may have a structure with an opening ranging from approximately 0.3 millimeters (mm) to approximately 1.0 mm in height, and has a width ranging from approximately 0.3 mm to approximately 2.0 mm. The ridge 48 extends lengthwise in the interior of the golf grip a desired distance ranging from approximately 175 mm to approximately 250 mm which may be substantially the length of the grip 10*c*.

Figure 10:
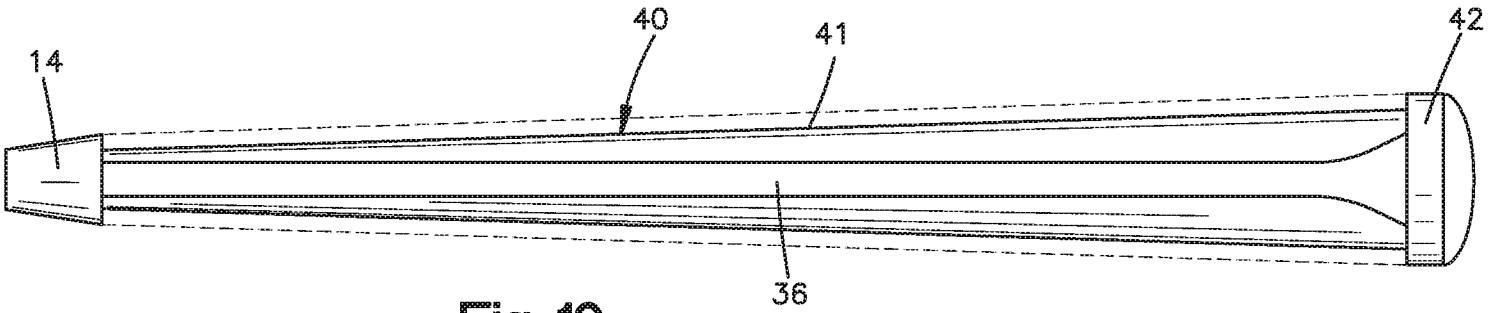
FIG. 10 is a rear view of an underlisting with a raised portion according to an embodiment of the present disclosure.
Figure 11:
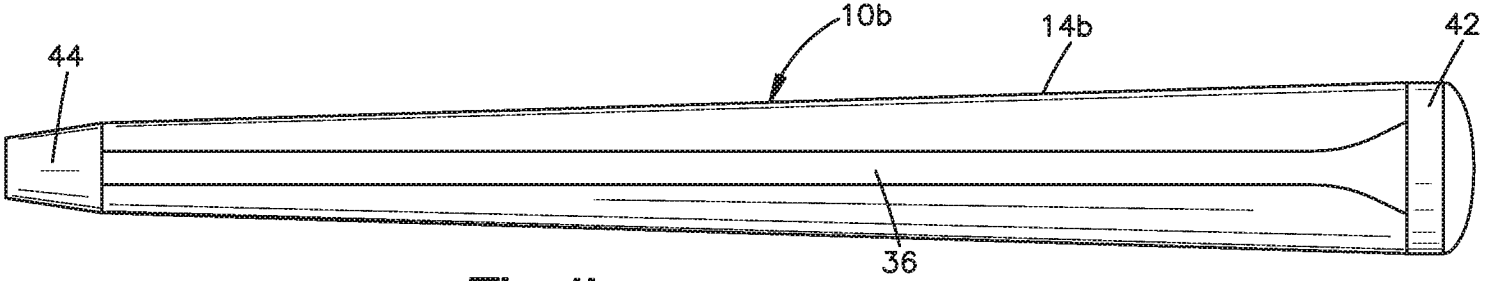
FIG. 11 is a similar view to that of FIG. 8 except showing the overmolded golf grip according to the present disclosure.

The present disclosure is also directed to an alternative unique two step molding process of forming the raised portion 36 on grip 10*b* which allows the raised portion 36 to be made from a different material from the rest of the grip 10*b*. Referring to FIGS. 10 and 11, a material is selected for an underlisting 40 which when molded is slightly smaller in size than the size of the final desired grip size. The final grip size is illustrated with dashed lines over the body 41 of the underlisting. The underlisting 40 is first molded by way of either compression molding, injection molding, or the like. The underlisting 40 is molded with the raised portion 36 on its exterior surface of the body 41 of the underlisting extending lengthwise on the underlisting 40 the desired distance as seen in FIG. 8. Underlisting 40 may include an end cap 42 and/or a bottom ferrule 44. The molded underlisting 40 may then either remain in the first mold (not shown) or positioned in a second mold (not shown) where a cover material for the body 14*b* of the grip 10*b* is overmolded directly on the underlisting 40 while leaving the raised portion 36 exposed. The cover material for the body 14*b* may be the same as the material used for the underlisting 40, or may be different. The raised portion 36 on the underlisting 40 remains exposed after the overmolding step. In this manner, the underlisting 40 may be of a different material from that of the final grip 10*b*. The raised portion 36 can have a different feel or texture from the body 14*b* of grip 10*b*. When the grip 10*b* is installed on the golf club shaft 12, the raised portion 36 becomes the reminder rib 20*b* as previously described.

In another embodiment, the raised portion 36 may be first molded in a mold cavity where only the raised portion 36 is formed. This operation may be in a separate mold or can be formed in the grip mold. When cured in a separate mold, the raised portion would be placed in the grip mold cavity and the grip body material is placed and fused to the raised portion during cure. If the raised portion is cured in the grip mold, then it would remain in the mold cavity while the grip body is then compressed or injected to fuse to the previously molded raised portion 36.

In another embodiment, the raised portion 36 may simply be co-cured to the grip body 14*b* during the same molding operation. This would involve placing uncured rubber in the raised portion cavity along with placing uncured grip body material, and co-curing both together in the mold. The mold forming the grooves on either side of the raised portion 36 would create a dam for preventing the migration of the raised portion material from flowing across the groove area.

Forming a raised portion 36 with a different material, like rubber, thermoplastic, silicone, or other suitable elastomeric polymer, from the grip body 10*b*, 10*c* provides the option of creating a reminder rib 20*b*, 20*c* that has different performance characteristics than the grip body material. The reminder rib 20*b*, 20*c* may be softer or harder than the rest of the grip body. It may have a different feel and/or slip resistance characteristic than the material forming the grip body. Furthermore, the raised portion 36 may include fiber reinforcement rubber material such as cotton to offer better slip resistance and wet weather performance.

The raised portion 36 allows the formation of a reminder rib 20*b*, 20*c* for a secure, repeatable feel regardless of grip size. Grips of larger sizes such as midsize and oversize have more material, and an internal rib or ridge 24 is not as effective with the higher wall thicknesses of these types of grips. This is likely due to the grip material deforming not directly in a manner projecting normal to the grip surface in the desired area or location. Swing grips have generally a frustoconical shape with a tapered wall thickness so an internal ridge or flat may form a reminder rib that is more noticeable in the thinner wall areas of the grip near the tip of the grip which slides first on the shaft, but may not be as noticeable at the larger diameter area near the butt end of the grip. This is an advantage of the raised portion 36 over the internal ridge 24 when forming a reminder rib for a golf grip. The raised portion 36 provides a more consistent presence or feel of the reminder rib 14 regardless of grip wall thickness or grip size.

While specific embodiments of the invention have been shown and described in detail to illustrate the application of the principles of the disclosure, it will be understood that the disclosure may be embodied otherwise without departing from such principles.

We claim:

1. An improved golf club grip with a reminder rib, comprising:

an elongated hollow tubular body having a bore at one end and an end cap at an opposite end, said tubular body having a wall with a predetermined thickness, an underside of said tubular body having a desired portion of said wall on an exterior surface having a greater thickness than the wall thickness of the remainder of said tubular body for forming a raised portion, a groove disposed immediately adjacent said raised portion, said groove continuously extending along and around said raised portion, said raised portion having a predetermined width and length at a predetermined location on the underside of said tubular body, said surrounding groove defining a longitudinal area of said raised portion in said tubular body, and reducing wall thickness of said tubular body around said raised portion to allow stretch upon installation of the golf club grip.

2. An improved golf club grip with a reminder rib as defined in claim 1, wherein said raised portion comprises a second material different from said tubular body material.

3. An improved golf club grip as defined in claim 1, wherein said longitudinal area of said raised portion includes a distinct texture from that of said tubular body.

4. An improved golf club grip as defined in claim 2, wherein said raised portion comprises a harder material than the material of said tubular body.

5. An improved golf club grip as defined in claim 2, wherein said raised portion comprises a softer material than the material of said tubular body.

6. An improved golf club grip as defined in claim 1, wherein said raised portion ranges from approximately 0.5 millimeters to approximately 2.0 millimeters in height, and has a width ranging from approximately 3.0 millimeters to approximately 10.0 millimeters.

7. An improved golf club grip as defined in claim 1, wherein said raised portion comprises a variable shape.

8. An improved golf club grip as defined in claim 7, wherein said raised portion extends lengthwise in a substantially straight line a desired distance ranging from approximately 175 millimeters to approximately 250 millimeters.

9. An improved golf club grip as defined in claim 1, wherein said raised portion forms a Y-shape near a butt end of the grip.

* * * * *